US010511394B2

(12) United States Patent
Saito et al.

(10) Patent No.: US 10,511,394 B2
(45) Date of Patent: Dec. 17, 2019

(54) SOUND PROCESSING APPARATUS AND METHOD

(71) Applicant: YAMAHA CORPORATION, Hamamatsu-shi (JP)

(72) Inventors: Kosuke Saito, Hamamatsu (JP); Shunichi Kamiya, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/257,293

(22) Filed: Jan. 25, 2019

(65) Prior Publication Data

US 2019/0158201 A1 May 23, 2019

Related U.S. Application Data

(63) Continuation of application No. PCT/JP2017/027029, filed on Jul. 26, 2017.

(30) Foreign Application Priority Data

Jul. 29, 2016 (JP) ..... 2016-149998

(51) Int. Cl.
*H04H 60/04* (2008.01)
*H04R 3/00* (2006.01)

(52) U.S. Cl.
CPC ..... *H04H 60/04* (2013.01); *H04R 3/00* (2013.01)

(58) Field of Classification Search
CPC ..... H04H 60/04; H04R 3/00
See application file for complete search history.

(56) References Cited

U.S. PATENT DOCUMENTS 8,312,375 B2 11/2012 Hamada
2016/0277134 A1* 9/2016 Terada ..... H04H 60/04

FOREIGN PATENT DOCUMENTS

JP 2006211174 A 8/2006
JP 2007036325 A 2/2007

OTHER PUBLICATIONS

English translation of Written Opinion issued in Intl. Appln. No. PCT/JP2017/027029 dated Oct. 17, 2017, previously cited in IDS filed Jan. 25, 2019.

(Continued)

*Primary Examiner* — Mark Fischer
(74) *Attorney, Agent, or Firm* — Rossi, Kimms & McDowell LLP

(57) ABSTRACT

A first adjuster (fader) adjusts volume of an input sound signal and sends the volume-adjusted sound signal to a first output destination. A second adjuster adjusts the volume of the sound signal before being subjected to the volume adjustment by the first adjuster (pre-fader sound signal) or the sound signal after having been subjected to the volume adjustment (post-fader sound signal). The second adjuster sends the volume-adjusted sound signal to a second output destination (such as a monitor output) different from the first output destination (such as a main output). A selector selects one of the pre-fader and post-fader sound signals. The sound signal selected by the selector is input to the second adjuster for volume adjustment. When the selection by the selector is changed, a controller changes the volume adjustment by the second adjuster on the basis of a volume difference between the pre-fader and post-fader sound signals.

17 Claims, 2 Drawing Sheets

(56) References Cited

OTHER PUBLICATIONS

International Preliminary Report on Patentability issued in Intl. Appln. No. PCT/JP2017/027029 dated Feb. 7, 2019. English translation provided.
International Search Report issued in Intl. Appln. No. PCT/JP2017/027029 dated Oct. 17, 2017. English translation provided.
Written Opinion issued in Intl. Appln. No. PCT/JP2017/027029 dated Oct. 17, 2017.

* cited by examiner

SOUND PROCESSING APPARATUS AND METHOD

PRIORITY

This application is based on, and claims priority to, JP PA 2016-149998 filed on 29 Jul. 2016 and International Patent Application No. PCT/JP2017/027029 filed on 26 Jul. 2017. The disclosure of the priority applications, in its entirety, including the drawings, claims, and the specification thereof, are incorporated herein by reference.

BACKGROUND

The embodiments of the present invention relates to a sound processing apparatus and method suited for use in, for example, audio mixers and the like.

Audio mixers (hereinafter referred to simply as "mixers") installed, for example, in concert venues and the like are generally constructed in such a manner that respective volume of sound signals (audio signals) input to individual channels are adjusted by faders of the channels, the volume-adjusted sound signals are output selectively to buses, the sound signals supplied from one or more of the channels are mixed in each of the buses, and the mixed results are output to output destinations. The output destinations of such a mixer are, for example, a main speaker oriented toward audience seats in the concert venue, a monitor speaker for a human player or players on the stage, and external equipment, such as a recording device and an effecter device.

Among the conventionally known mixers is one that is capable of setting, for each input channel and for each output bus, a "pre-fader mode" in which a sound signal before being subjected to volume adjustment by a fader is supplied to the output bus or a "post-fader mode" in which a sound signal after having been subjected to the volume adjustment by the fader is supplied to the output bus. A human operator of the mixer can select one of the post-fader sound signal and the pre-fader sound signal as a sound signal to be output, for example, to a monitor speaker, an effecter device, and the like.

For example, the human operator uses the post-fader mode when he or she wants to change volume (sound volume) of a sound signal to be sent to a given output bus in synchronism with the volume adjustment by the fader, but uses the pre-fader mode when he or she does not want to change the volume of the sound signal in synchronism with the volume adjustment by the fader. More specifically, when a human player's own performance sound is to be output, for example, to the monitor speaker for human players on the stage, the pre-fader mode is used with respect to an output bus for the monitor speaker. Further, when a reproduced sound of a CD or the like is to be sent to the monitor speaker for human players, or when a performance sound is to be sent to an external effecter device, for example, the post-fader mode is often used with respect to the corresponding output bus.

Switching between the pre-fader mode and the post-fader mode as above is convenient in that a sound signal to be sent to an output bus can be selected as necessary depending on an intended use of an output destination. However, the conventionally known mixer construction would present the problem that when switching has been made between the pre-fader mode and the post-fader mode, the volume of the sound signal to be sent to the output bus changes by an amount of the volume adjustment by the fader. For example, when switching has been made from the pre-fader mode to the post-fader mode in the case where the volume of the sound signal is increased by the fader, the volume of the sound signal of the post-fader mode to be output to the corresponding output bus increases by the amount of the volume adjustment by the fader as compared with the sound signal of the pre-fader mode before the switching. Conversely, when switching has been made from the post-fader mode to the pre-fader mode, the volume of the sound signal of the pre-fader mode to be output to the corresponding output bus decreases by the amount of the volume adjustment by the fader as compared with the sound signal of the post-fader mode before the switching. Such a sound volume change not intended by the human operator would cause inconveniences, such as giving an uncomfortable feeling to listeners or audience.

SUMMARY

In view of the foregoing prior art problems, it is one of the objects of the present invention to provide a sound processing apparatus and method capable of preventing an undesired sound volume change.

In order to accomplish the aforementioned this and other objects, the inventive sound processing apparatus includes: a first adjuster that adjusts volume of an input sound signal, the sound signal having the volume adjusted by the first adjuster being sent to a first output destination; a second adjuster that adjusts the volume of the sound signal before being subjected to the volume adjustment by the first adjuster or the sound signal after having been subjected to the volume adjustment by the first adjuster, the sound signal having the volume adjusted by the second adjuster being sent to a second output destination different from the first output destination; a selector that selects one of the sound signal before being subjected to the volume adjustment by the first adjuster and the sound signal after having been subjected to the volume adjustment by the first adjuster, the sound signal selected by the selector being input to the second adjuster for volume adjustment; and a controller that, once the selection by the selector is changed, changes the volume adjustment by the second adjuster based on a volume difference between the sound signal before the volume adjustment by the first adjuster and the sound signal after the volume adjustment by the first adjuster.

According to the inventive sound processing apparatus, once the selection by the selector is changed, namely, once the sound signal to be input to the second adjuster (or the sound signal to be output to the second output destination) is switched from the sound signal before (being subjected to) the volume adjustment by the first adjuster to the sound signal after (having been subjected to) the volume adjustment by the first adjuster or from the sound signal after the volume adjustment by the first adjuster to the sound signal before the volume adjustment by the first adjuster, the volume adjustment by the second adjuster is changed on the basis of the volume difference between the sound signal before the volume adjustment by the first adjuster and the sound signal after the volume adjustment by the first adjuster. With such arrangements, the inventive sound processing apparatus can compensate for a volume change in the sound signal to be input to the second adjuster that occurs due to the volume difference between the sound signal before the volume adjustment by the first adjuster and the sound signal after the volume adjustment by the first adjuster, with the result that the inventive sound processing apparatus can prevent an undesired change in the volume of the sound signal to be sent from the second adjuster to the second output destination.

In a preferred embodiment, the controller is configured to be capable of changing the volume adjustment by the second adjuster on the basis of the volume difference between the sound signal before the volume adjustment by the first adjuster and the sound signal after the volume adjustment by the first adjuster, so as to suppress a volume change in the output of the second adjuster responsive to a volume change in the sound signal to be input to the second adjuster that occurs in response to the change of the selection by the selector.

When the sound signal to be sent to the second output destination has been switched between the sound signal before the volume adjustment by the first adjuster and the sound signal after the volume adjustment by the first adjuster, the inventive sound processing apparatus can compensate for the volume difference between the sound signal before the volume adjustment by the first adjuster and the sound signal after the volume adjustment by the first adjuster and thereby suppress a volume change (keep substantially constant the volume of) the sound signal to be sent to the second output destination. Thus, the inventive sound processing apparatus can prevent an undesired volume change in the second output destination, and as a result, the present invention can, for example and thereby prevent the sound signal switching from giving an uncomfortable feeling to listeners or audience.

Also, disclosed herein are an inventive method including steps corresponding to the individual component elements of the aforementioned apparatus and an inventive computer-readable, non-transitory storage medium storing a group of instructions executable by one or more processors for performing the method.

BRIEF DESCRIPTION OF DRAWINGS

Certain embodiments will hereinafter be described in detail, by way of example only, with reference to the accompanying drawings, in which.

DETAILED DESCRIPTION

Figure 1:
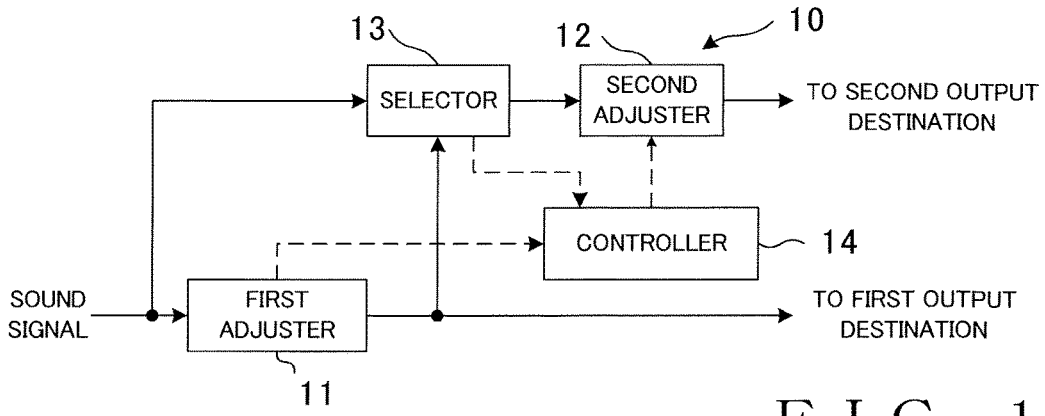
FIG. 1 is a conceptual block diagram explanatory of an example construction of an inventive sound processing apparatus.

FIG. 1 is a conceptual block diagram explanatory of an example construction of the inventive sound processing apparatus. In FIG. 1, the sound processing apparatus 1 includes a first adjuster 11 that adjusts volume (sound volume) of an input sound signal (audio signal), and a second adjuster 12 that adjusts the sound signal before being subjected to the volume adjustment by the first adjuster 11 or the sound signal after having been subjected to the volume adjustment by the first adjuster 11. The sound signal adjusted in volume (or volume-adjusted) by the first adjuster 11 is sent to a first output destination, while the sound signal adjusted in volume (volume-adjusted) by the second adjuster 12 is sent to a second output destination different from the first output destination. The sound processing apparatus 10 further includes a selector 13 one of the sound signal before being subjected to the volume adjustment by the first adjuster 11 and the sound signal after having been subjected to the volume adjustment by the first adjuster 11, and the sound signal selected by the selector 13 is input to the second adjuster 12 for volume adjustment. The sound processing apparatus 10 further includes a controller 14 that, once the selection by the selector 13 is changed, changes the volume adjustment (such as a volume adjusting value) by the second adjuster 12 on the basis of a volume difference between the sound signal before the volume adjustment by the first adjuster 11 and the sound signal after the volume adjustment by the first adjuster 11. Preferably, on the basis of a volume difference between the sound signal before the volume adjustment by the first adjuster 11 and the sound signal after the volume adjustment by the first adjuster 11, the controller 14 changes the volume adjustment (such as a volume adjusting value) by the second adjuster 12 so as to suppress a volume change in the output of the second adjuster 12 corresponding to a volume change of the sound signal to be input to the second adjuster 12 which occurs due to the change of the selection by the selector 13.

The sound processing apparatus 10 of FIG. 1 is applicable to various acoustic equipment, such as audio mixers, which handle sound signals. The following embodiment will be described hereinbelow in relation to an example where the sound signal processing apparatus 10 is applied to an audio mixer (also referred to simply as "mixer"). The mixer 20 may be either a digital mixer that processes sound signals exclusively through digital signal processing or an analog mixer that processes sound signals through analog signal processing. In the illustrated example, the mixer 20 is a digital mixer.

Figure 2:
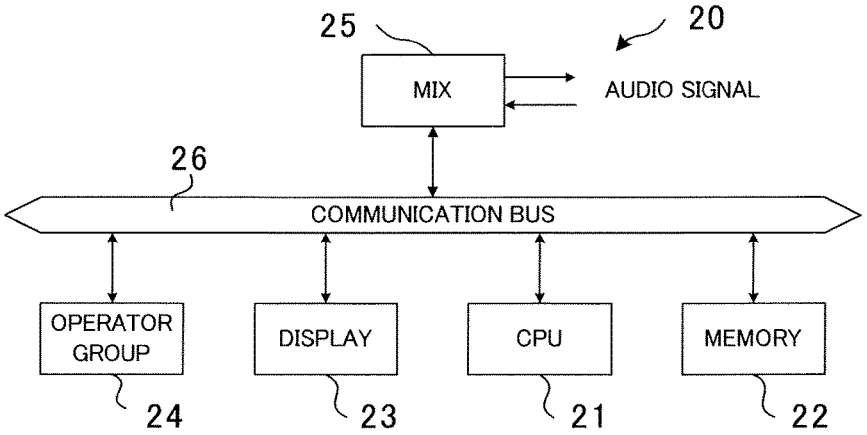
FIG. 2 is a block diagram illustrating an example electric hardware construction of an audio mixer to which the sound processing apparatus of FIG. 1 is applied.

FIG. 2 is a block diagram illustrating an example electric hardware construction of the mixer 20. The mixer 20 includes a CPU (Central Processing Unit) 21, a memory 22, a display 23, an operator group 24, and a mixing section ("MIX" in the FIG. 25, and these components 21 to 25 are interconnected via a bus 26.

The CPU 21 controls the mixer 20 by executing various programs stored in the memory 22. The memory 22 not only non-volatilely stores various programs to be executed by the CPU 21 and various data, but also is used as a loading area for loading programs to be executed by the CPU 21 and as a working area. The memory 22 may be implemented by combining as necessary various memory devices, such as a read-only memory, a random-access memory, a flash memory and a hard disk.

The display 23 displays various information, which is based on display control signals given from the CPU 21, in various images, character strings, and the like. The operator group 24 includes a plurality of manual operators disposed on an operation panel of the mixer 20, interface circuits related to the operators, and the like. The operator group 24 includes a plurality of fader operators, rotary-type knob operators to be used for send level adjustment and the like, and switches for selecting sound signals to be supplied to one or more AUX buses as will be described later. The user uses the operator group 24 to perform various operations that include setting of sound signal paths, adjustment of values of various parameters, and the like. The CPU 21 acquires a detection signal corresponding to a user's input operation on the operator group 24 or the display 23 and controls the behavior of the mixer 20 on the basis of the acquired detection signal.

The mixing section 25 is constituted by a signal processing device that is implemented virtually, for example, by a DSP (Digital Signal Processor), the CPU 21, and software stored in the memory 22. The mixing section 25 processes one or more sound signals supplied from not-shown input equipment by using a signal processing program, and then the mixing section 25 outputs the processed sound signals to not-shown output equipment.

Figure 3:
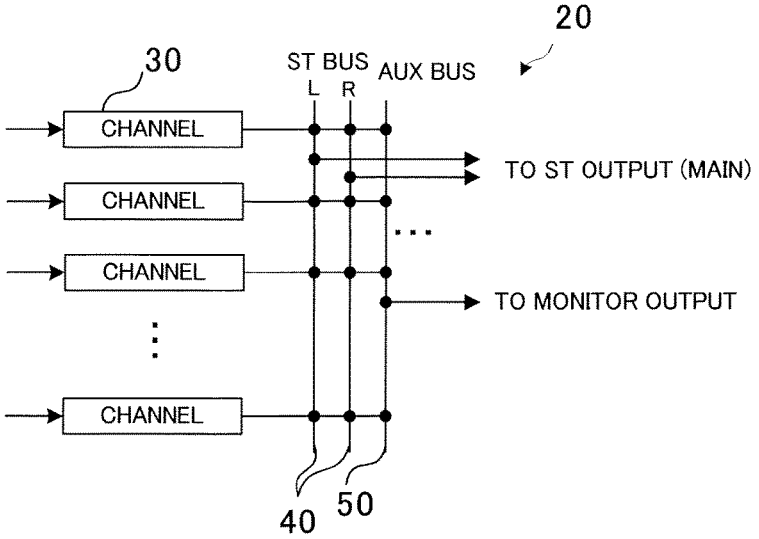
FIG. 3 is a block diagram explanatory of an example construction of signal processing performed in the audio mixer of FIG. 2.

FIG. 3 illustrates an example construction of the signal processing performed by the mixing section 25 of the mixer 20. The mixer 20 includes a plurality of channels 30, and a plurality of buses including stereo buses 40 ("ST BUSES" in the figure) for main output and one or more auxiliary buses 50 ("AUX BUS" in the figure) for monitor output. Each of the channels 30 performs various signal processing, including volume adjustment, on an input sound signal and supplies the processed sound signal to one or more of the buses 40 and 50 selected by the human operator. Each of the buses 40 and 50 mixes sound signals supplied from one or more of the channels 30 and outputs the mixed sound signal to a corresponding output destination. The human operator of the mixer 20 uses the operator group 24 to perform operations for adjusting values of various signal processing parameters of the individual channels 30 and operations for setting paths of sound signals including connections between the individual channels 30 and the individual buses 40 and 50. In response to such human operator's operations via the operator group 24, the CPU 21 changes the values of the parameters stored in the memory 22. The signal processing by the mixing section 25 of FIG. 2 is controlled on the basis of the values of the parameters stored in the memory 22. The main output system includes main output channels and output devices (such as main stereo speakers), and the monitor output system includes monitor output channels and monitor output devices (such as various monitoring headphones and speakers).

Figure 4:
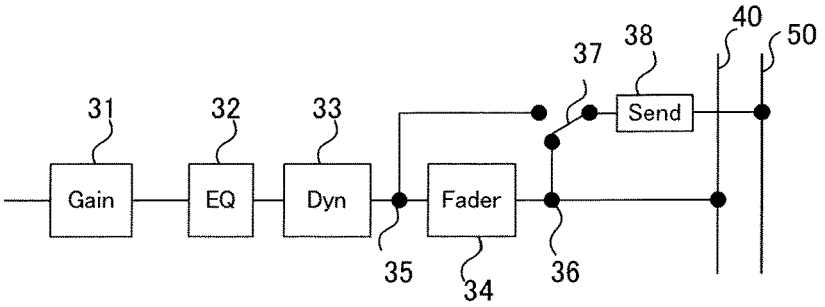
FIG. 4 is a block diagram explanatory of an example construction of a channel in the audio mixer of FIG. 2.

FIG. 4 illustrates an example of a detailed construction of one of the channels 30. The one channel 30 is configured to adjust a gain by a gain adjuster 31 ("Gain" in FIG. 4), perform effect processing on the gain-adjusted sound signal by effect modules, such as an equalizer 32 (hereinafter also referred to as "EQ") and a dynamics control 33 ("Dyn" in FIG. 4), adjust volume of the effect-processed sound signal by a fader 34 ("Fader" in FIG. 4), and then supply the volume-adjusted sound signal to the stereo buses 40. As known in the art, the equalizer 32 is an effect impartment circuit relating to frequencies, and the dynamics control 33 is an effect impartment circuit (such as a limiter and a compressor) relating to volume.

In the illustrated example of FIG. 4, the one channel 30 includes two sound signal takeout points, which connect to the AUX bus 50, at two positions, i.e., a point 35 immediately preceding or before the fader 34 ("pre-fader") and a point 36 immediately following or after the fader 34 ("post-fader"), and a desired one of a sound signal at the pre-fader 35 and a signal at the post-fader 36 can be selected as a sound signal to be sent to the AUX bus 50. When the pre-fader 35 has been selected, the sound signal before (being subjected to) the volume adjustment by the fader 34 is supplied to the AUX bus 50 after being adjusted in send level (volume) by a send level adjuster 38. When the post-fader 36 has been selected, on the other hand, the sound signal after (having been subjected to) the volume adjustment by the fader 34 is supplied to the AUX bus 50 after being adjusted in send level (volume) by the send level adjuster 38. Each of the channels 30 includes a plurality of selection switches 37 and a plurality of send level adjusters 38 that correspond to individual AUX buses 50. Each of the send level adjusters 38 adjusts the send level at which the sound signal of the channel 30 is to be sent to the AUX bus 50 corresponding to the send level adjuster 38. As known in the art, various parameters (such as adjusting or setting values) to be used in the gain adjuster 31, equalizer 32, dynamics control 33, fader 34, and send level adjuster 38 are not only adjustable by user's manual operations but also automatically adjustable in accordance with various data, such as sequence data. An operating state of each of the selection switches 37 too is not only selectable/switchable by a user's manual operation but also automatically adjustable in accordance with various data, such as sequence data.

Typically, each of the stereo buses 40 is connected via a not-shown stereo output channel to the main output device of the mixer 20; the main output device is, for example, a main speaker oriented toward audience seats in a concert venue. The plurality of AUX buses 50 are connectable via not-shown output channels to output devices of various uses. Such output devices that are output destinations of the AUX buses 50 are, for example, a monitor speaker (monitor output device) oriented toward human players on a stage in a concert venue or the like, external equipment, such as an effecter device, and the like.

When the sound signal takeout point connecting to a given AUX bus 50 has been switched in a given channel 30 from the pre-fader 35 to the post-fader 36 or from the post-fader 36 to the pre-fader 35, the volume of the sound signal to be sent to the send level adjuster 38 changes by an amount of a volume difference between the sound signal before the fader 34 and the sound signal after the fader 34. Note that the volume difference between the sound signal before the fader 34 and the sound signal after the fader 34 is a difference between the volume of the sound signal before being input to the fader 34 and the volume of the sound signal after having been output from the fader 34. Heretofore, such a volume change in an input signal to the send level adjuster 38 was not compensated for, resulting in an inconvenience of volume of an output signal changing in response to the volume change in the input signal although the user did not intentionally change any of the adjusting and setting parameter parameters in the send level adjuster 38. Consequently, the volume of the sound signal to be sent from the send level adjuster 38 to the AUX bus 50 changes undesirably and thus gives an uncomfortable feeling to listeners who listen to the sound signal sounded or audibly generated via the AUX bus 50. In order to remove such an inconvenience, the mixer 20 according to the present embodiment is constructed in such a manner that, once the takeout point connecting to a given AUX bus 50 is switched in a given channel 30, the mixer 20 automatically changes a value (send level value) of the corresponding send level adjuster 38 on the basis of a volume difference between the sound signal before the fader 34 of the channel 30 and the sound signal after the fader 34 (through processing by the controller 14 shown in FIG. 1).

Figure 5:
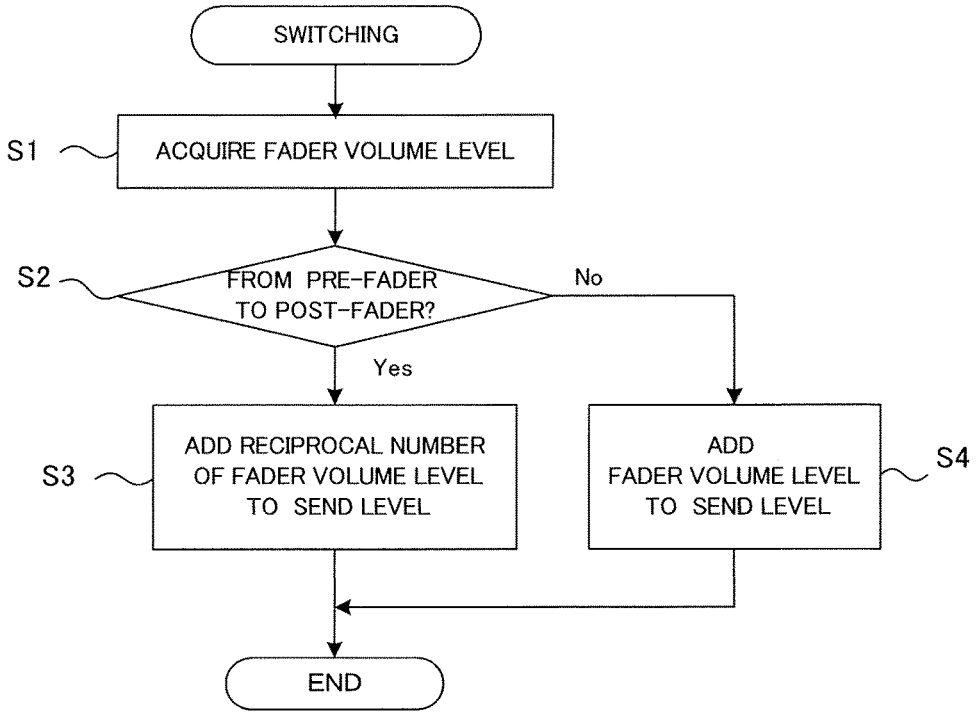
FIG. 5 is a flow chart illustrating an example of processing responsive to a takeout point switching operation.

FIG. 5 is a flow chart illustrating an example of processing performed by the CPU 21 when the takeout point has been switched in a given channel 30. At step S1, the CPU 21 acquires from the memory 22 a value (fader level value) set in the fader 34 of the channel 30 where the takeout point has been switched. As an example, the fader level value is any one of values in a range from a lower limit value (e.g. −∞ dB) to an upper limit value (e.g. +10 dB). When the fader level value is a predetermined reference value (e.g. 0 dB), the fader 34 outputs an input signal without effecting a volume change. When the fader level value is +3 dB, for example, the fader 34 outputs the input sound signal after increasing the volume of the input sound signal by 3 dB. When the fader level value is −3 dB, for example, the fader 34 outputs the input sound signal after decreasing the volume of the input sound signal by 3 dB. Thus, a volume difference corresponding to the fader level value exists between the sound signal before the fader 34 and the sound signal after the fader 34. Therefore, the CPU 21 can acquire the volume difference between the sound signal before the fader 34 and the sound signal after the fader 34 on the basis of the fader level value.

At step S2, the CPU 21 determines whether the aforementioned switching is from the pre-fader 35 to the post-fader 36 or from the post-fader 36 to the pre-fader 35. If the switching is from the pre-fader 35 to the post-fader 36 as determined at step S2 (Yes determination at step S2), the CPU 21 goes to step S3, where the CPU 21 changes the send level value of the send level adjuster 38 so as to cancel out the volume change of the input signal indicated by the acquired fader level value (for example, the CPU 21 multiplies a corresponding send level value by the reciprocal number of the acquired fader level value). Namely, of the values of various parameters stored in the memory 22, the CPU 21 changes the send level value of the send level adjuster 38 of the channel 30, where the switching has been effected, on the basis of the acquired volume difference between the sound signal before the fader 34 and the sound signal after the fader 34. When the fader level value is −3 dB, for example, the CPU 21 changes the current send level value (setting) of the send level adjuster 38 in such a manner that +3 dB is added to the current send level value (setting). Further, when the fader level value is +3 dB, for example, the CPU 21 changes the current send level value (setting) of the send level adjuster 38 in such a manner that −3 dB is added to the current send level value (setting) (namely, the current send level value (setting) decreases by 3 dB).

If the switching is from the post-fader 36 to the pre-fader 35 as determined at step S2 (No determination at step S2), on the other hand, the CPU 21 goes to step S4, where the CPU 21 changes the send level value of the send level adjuster 38 so as to reflect the volume change of the input signal indicated by the acquired fader level value (for example, the CPU 21 multiplies the corresponding send level value by the acquired fader level value). Namely, of the values of various parameters stored in the memory 22, the CPU 21 changes the send level value of the send level adjuster 38 of the channel 30, where the switching has been effected, on the basis of the acquired volume difference between the sound signal before the fader 34 and the sound signal after the fader 34. When the fader level value set in the fader 34 is −3 dB, for example, the CPU 21 changes the current send level value (setting) of the send level adjuster 38 in such a manner that −3 dB is added to the current send level value (setting) (namely, the current send level value (setting) decreases by 3 dB). Further, when the fader level value set in the fader 34 is +3 dB, for example, the CPU 21 changes the current send level value (setting) of the send level adjuster 38 in such a manner that +3 dB is added to the current send level value (setting).

By changing, in response to the switching between the pre-fader and the post-fader of the sound signal to be sent to the AUX bus 50, the value set in the send level adjuster 38 on the basis of the value set in the fader 34 as above, the mixer 20 according to the embodiment can compensate for the volume difference between the sound signal before the fader 34 and the sound signal after the fader 34 and thereby suppress a volume change of the sound signal to be sent to the AUX bus 50 (for example, keep the volume substantially constant). Thus, the mixer 20 according to the embodiment can prevent an undesired volume change in an output destination of the AUX bus 50 at the time of the switching between the pre-fader and the post-fader. As a result, the mixer 20 can prevent giving an uncomfortable feeling to listeners at the time of the switching between the pre-fader and the post-fader.

When a reproduced sound of a CD or the like is to be supplied to a monitor speaker for human players connected to the AUX bus 50, for example, the post-fader 36 is often selected in such a manner that a sound signal volume-adjusted by the fader 34 is supplied to the AUX bus 50. Because, it is preferable that the volume of the reproduced sound of a CD or the like from the monitor speaker be adjustable in synchronism with the main output volume adjustment by the fader 34. In initial setting of a conventionally known mixer 20, on the other hand, the pre-fader 35 is often set as a monitor output. Thus, in the case where a reproduced sound of a CD or the like is output to the monitor speaker via the AUX bus 50, it is possible that the human operator of the mixer forgets to make a setting to switch to the post-fader 36 a route or path of the sound signal to be supplied to the AUX bus 50 and then starts outputting the reproduced sound of a CD or the like to the monitor speaker while leaving the pre-fader 35 still selected. Upon noticing such a setting mistake, the human operator operates the selection switch 37 so as to switch, from the pre-fader 35 to the post-fader 36, the sound signal to be supplied to the AUX bus 50. In such a case, the mixer 20 according to the embodiment can switch the output to the monitor speaker from the pre-fader 35 to the post-fader 36 while keeping substantially constant the volume of the sound signal to be supplied to the AUX bus 50 without giving an uncomfortable feeling to the human players and the like.

Note that the operation for changing the value set in the send level adjuster 38 at step S3 and S4 above may be any operation other than multiplication, such as addition or subtraction, as long as the operation can change the value set in the send level adjuster 38 on the basis of the value set in the fader 34.

In the above-described embodiment, the fader 34 corresponds to the first adjuster 11 of FIG. 1, the send level adjuster 38 corresponds to the second adjuster 12, the selection switch 37 corresponds to the selector 13, the stereo bus 40 (and the main output channel and device corresponding to the stereo bus 40) corresponds to the first output destination of FIG. 1, the AUX bus 50 (and the monitor output channel and device, external equipment, etc. corresponding to the AUX bus 50) corresponds to the second output destination of FIG. 1, and the operations of steps S1 to S4 performed by the CPU 21 correspond to the control performed by the controller 14 of FIG. 1.

Figure 6:
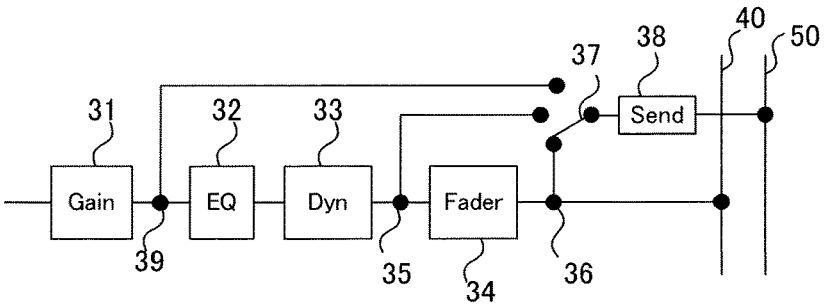
FIG. 6 is a block diagram explanatory of another example construction of a channel in another embodiment of the inventive sound processing apparatus.

As another embodiment, the controller 14 may be configured to acquire a volume difference on the basis of measured values of volume of the sound signals before and after the first adjuster 11 (step S2) instead of acquiring a static value, such as the aforementioned fader level value, as the volume difference before and after the first adjuster 11, and then change the send level value on the basis of the volume difference based on the measured values of volume (steps S3 and S4). FIG. 6 illustrates an example of a channel construction explanatory of the other embodiment. In the example construction of FIG. 6, the sound signal takeout points connecting to the AUX bus 50 are provided at three positions, i.e., a pre-EQ 39 before the EQ 32, the pre-fader 35, and the post-fader 36. Thus, in this case, the EQ 32, the dynamics control 33, and the fader 34 correspond to the first adjuster 11 of FIG. 1.

In the example construction of FIG. 6, where the pre-EQ 39 is added to the example construction of FIG. 4, it is desirable to acquire a volume difference between before the EQ 32 and after the dynamics control 33 in addition to a volume difference between before and after the fader 34. Note that the volume difference between before the EQ 32 and after the dynamics control 33 is a difference between volume of the sound signal before being input to the EQ 32 and volume of the sound signal after having been output from the dynamics control 33. As known in the art, the EQ 32 is an effect module that adjusts frequency characteristics of the sound signal by adjusting volume on a frequency-band-by-frequency-band basis, and the dynamics control 33 is an effect module that includes, for example, a compressor, a limiter, and the like so as to adjust volume characteristics of the sound signal.

Once the sound signal takeout point of a given channel 30 is switched from the pre-EQ 39 to the pre-fader 35 or from the pre-EQ 39 to the post-fader 36, the CPU 21 goes to step S2, where it acquires, as the volume difference between before the EQ 32 and after the dynamics control 33, a volume difference based on a measured volume value of the sound signal before being input to the EQ 32 and a measured volume value of the sound signal after having been output from the dynamics control 33. Generally, in the mixer 20, volume of sound signals is always measured at a plurality of positions before and after various processing modules, such as the EQ 32 and the dynamics control 33, so as to be used for level meter display purposes. Thus, such measured volume values to be used for level meter display purposes can be used as the volume difference between before the EQ 32 and after the dynamics control 33.

As an example, the CPU 21 averages measured values of volume before the EQ 32 and measured values of volume after the dynamics control 33 (namely, calculates an arithmetic average) every predetermined time and stores the calculated arithmetic averages of the respective measured values of volume into the memory 22. Then, at step S2 above, the CPU 21 calculates a volume difference based on the latest average of the measured values of volume before the EQ 32 and the latest average of the measured values of volume after the dynamics control 33.

Once switching is effected from the pre-EQ 39 to the pre-fader 35, for example, the CPU 21 in the present embodiment adds the reciprocal number of the calculated volume difference to the corresponding send level value (step S3 above). Further, once switching is effected from the pre-fader 35 to the pre-EQ 39, the CPU 21 in the present embodiment adds the calculated volume difference to the corresponding send level value (step S4 above). Furthermore, once switching is effected from the pre-EQ 39 to the post-fader 36, the CPU 21 adds the reciprocal number of the sum of the calculated volume difference and the fader level value to the corresponding send level value (step S3 above). Furthermore, once switching is effected from the post-fader 36 to the pre-EQ 39, the CPU 21 adds the sum of the calculated volume difference and the fader level value to the corresponding send level value (step S4 above).

Because results of processes performed by the EQ 32 and the dynamics control 33 on the sound signal depend on components of the input sound signal, it is difficult to obtain a compensating value for the volume difference between the sound signal before the EQ 32 and the sound signal after the dynamics control 33 by use of static parameter values, such as gain values, set in the EQ 32 and in the dynamics control 33. In such a case, the volume difference occurring at the time of the takeout point switching can be compensated for appropriately by using the volume difference based on the measured values of volume as noted above.

Note that because no difference appears between the measured values of volume before the EQ 32 and after the dynamics control 33 when there is no input sound, it may be better to exercise at step S2 some ingenuity, such as removing from the calculation of the average (arithmetic average) the values measured when there is no input sound. As another example, another average calculation method or a representative value determination method may be employed in place of the aforementioned arithmetic average calculation. For example, peaks of the measured values of volume before the EQ 32 may be traced (interpolated) temporally or over time and peaks of the measured values of volume after the dynamics control 33 may be traced (interpolated) temporally in such a manner that these traced values (interpolated values) are set as respective representative values of the measured values of volume before the EQ 32 and the measured values of volume after the dynamics control 33 and that a difference between the respective representative values is determined as the above-mentioned volume difference.

As still another example, the CPU 21 may acquire at step S2 the volume difference between the sound signal before the EQ 32 and the sound signal after the dynamics control 33 on the basis of parameter values (static values) set in the EQ 32 and/or the dynamics control 33.

As still another example, the CPU 21 may acquire at step S2 the volume difference between the sound signal before the fader 34 and the sound signal after the fader 34 on the basis of the measured vales of volume before and after the fader 34.

As still another embodiment, limiting values may be set with respect to the change amounts of the send level value at steps S3 and S4 (namely, the change amounts may be limited within predetermined limit values). If the send level value is changed by an extremely great amount at steps S3 and S4, there may arise inconveniences, such as an inconvenience of the changed results themselves becoming undesired volume changes. In other words, the send level value adjustment at steps S3 and S4 is basically minute adjustment. Thus, by limiting adjusted widths of the send level 38 (volume change amounts) at steps S3 and S4 within predetermined limit values, it is possible to prevent inconveniences and erroneous operation, such as undesired volume changes. As an example, an appropriate limiting value is set with respect to the fader level value acquired as a volume difference at step S2 above. As still another example, when a volume difference is to be calculated on the basis of the measured values of volume at step S2, an appropriate limiting value is set with respect to the volume difference to be calculated. Particularly, in calculation of a volume difference on the basis of measured values of volume, a great value can be calculated due to a local situation.

In still another embodiment, the CPU 21 may be configured to convert the volume difference acquired at step S2 above into a change amount of the send level value on the basis of a conversion table prestored, for example, in the memory 22 and then effects the send level change at step S3 or S4.

In yet still another embodiment, the second adjuster 12 may be configured to adjust volume of a direct-out sound for which a sound signal of a given channel 30 is to be output directly to the outside instead of being output to the outside via the AUX bus 50. In this case, the controller 14 acquires a volume difference between the sound signal before the first adjuster 11 and the sound signal after the first adjuster 11 and changes the volume of the direct-out sound on the basis of the acquired volume difference.

In yet still another embodiment, the takeout point may be provided at any desired plural number of positions within each of the channels rather than three positions as illustratively shown in FIGS. 4 and 6.

Although various embodiments have been described above, it should be appreciated that the inventive sound processing apparatus is not limited to the above-described embodiments and may be modified variously within the scope of the technical idea disclosed in the claims, description and drawings. For example, the inventive sound processing apparatus 10 may be applied to any devices and apparatus, such as a recorder and a processor, rather than being limited only to the mixer 20 as long as such devices and apparatus handle sound signals. Further, the sound processing apparatus 10 may be constructed of a dedicated hardware apparatus (integrated circuit etc.) that is configured to perform the functions of the components 11, 12, 13, and 14 shown in FIG. 1. Furthermore, the sound processing apparatus 10 may be implemented by a processor device that executes a program for performing the functions of the components 11, 12, 13, and 14 shown in FIG. 1. For example, the sound processing apparatus 10 is applicable to a DAW (Digital Audio Workstation) software application that is run on a personal computer.

One aspect of the inventive sound processing apparatus understood from the above-described embodiments is a sound processing apparatus (10, 20) which includes: a first adjuster (11, 12, 34) that adjusts volume of an input sound signal, the sound signal having the volume adjusted by the first adjuster being sent to a first output destination; a second adjuster (12, 24, 38) that adjusts the volume of the sound signal before being subjected to the volume adjustment by the first adjuster or the sound signal after having been subjected to the volume adjustment by the first adjuster, the sound signal having the volume adjusted by the second adjuster being sent to a second output destination different from the first output destination; a selector (13, 24, 37) that selects one of the sound signal before being subjected to the volume adjustment by the first adjuster and the sound signal after having been subjected to the volume adjustment by the first adjuster, the sound signal selected by the selector being input to the second adjuster for volume adjustment; and a controller (14, 21, S1 to S4) that, in response to the selection by the selector being changed, changes the volume adjustment by the second adjuster on the basis of a volume difference between the sound signal before the volume adjustment by the first adjuster and the sound signal after the volume adjustment by the first adjuster.

In the above-described specific example, the controller includes the memory (22) and the processor (CPU 21). The processor (CPU 21) is configured in such a manner that, in response to the selection by the selector being changed, the processor executes, on the basis of a group of instructions stored in the memory (22), a task (S1 to S4) of changing the volume adjustment by the second adjuster on the basis of a volume difference between the sound signal before the volume adjustment by the first adjuster and after the sound signal after the volume adjustment by the first adjuster.

Further, the above-described embodiment based on the control by the CPU 21 can be understood as a method for setting volume of a sound signal by a processor (CPU 21). This method includes: a first adjustment step of adjusting volume of an input sound signal, the sound signal having the volume adjusted by the first adjustment step being sent to a first output destination; a second adjustment step of adjusting the volume of the sound signal before being subjected to the volume adjustment by the first adjustment step or the sound signal after having been subjected to the volume adjustment by the first adjustment step, the sound signal having the volume adjusted by the second adjustment step being sent to a second output destination different from the first output destination; a step of selecting one of the sound signal before being subjected to the volume adjustment by the first adjustment step and the sound signal after having been subjected to the volume adjustment by the first adjustment step, the sound signal selected by the selector being input to the second adjustment step for volume adjustment; and a step of, in response to the selection by the selector being changed, changing the volume adjustment by the second adjustment step on the basis of a volume difference between the sound signal before the volume adjustment by the first adjustment step and the sound signal after the volume adjustment by the first adjustment step. Furthermore, the above-described embodiment based on the control by the CPU 21 can also be understood as a program for causing a computer to perform the individual steps constituting the aforementioned method, or a computer-readable, non-transitory storage medium storing the program.

The foregoing disclosure has been set forth merely to illustrate the embodiments of the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A sound processing apparatus comprising:

a first adjuster that adjusts volume of an input sound signal, the sound signal having the volume adjusted by the first adjuster being sent to a first output destination;

a second adjuster that adjusts the volume of the sound signal before being subjected to the volume adjustment by the first adjuster or the sound signal after having been subjected to the volume adjustment by the first adjuster, the sound signal having the volume adjusted by the second adjuster being sent to a second output destination different from the first output destination;

a selector that selects one of the sound signal before being subjected to the volume adjustment by the first adjuster and the sound signal after having been subjected to the volume adjustment by the first adjuster, the sound signal selected by the selector being input to the second adjuster for volume adjustment; and a controller that, once the selection by the selector is changed, changes the volume adjustment by the second adjuster based on a volume difference between the sound signal before the volume adjustment by the first adjuster and the sound signal after the volume adjustment by the first adjuster.

2. The sound processing apparatus as claimed in claim 1, wherein the controller changes the volume adjustment by the second adjuster, based on the volume difference between the sound signal before the volume adjustment by the first adjuster and the sound signal after the volume adjustment by the first adjuster, so as to suppress a volume change in output of the second adjuster responsive to a volume change in the sound signal to be input to the second adjuster that occurs in response to the change of the selection by the selector.

3. The sound processing apparatus as claimed in claim 2, wherein the controller is configured to change the volume adjustment by the second adjuster in accordance with a reciprocal number of the volume difference once the selection by the selector is changed in such a manner that switching is effected from the sound signal before being subjected to the volume adjustment to the sound signal after having been subjected to the volume adjustment, and change the volume adjustment by the second adjuster in accordance with the volume difference once the selection by the selector is changed in such a manner that switching is effected from the sound signal after having been subjected to the volume adjustment to the sound signal before being subjected to the volume adjustment.

4. The sound processing apparatus as claimed in claim 1, wherein the controller is configured to acquire information indicative of the volume difference based on a volume adjusting value set in the first adjuster.

5. The sound processing apparatus as claimed in claim 1, wherein the controller is configured to acquire information indicative of the volume difference based on a measured value of volume of the sound signal before being subjected to the volume adjustment and a measured value of volume of the sound signal after having been subjected to the volume adjustment.

6. The sound processing apparatus as claimed in claim 5, wherein the controller is configured to obtain an average value for each of the measured values of volume and acquire the information indicative of the volume difference based on a difference between the obtained average values of the measured values of volume.

7. The sound processing apparatus as claimed in claim 1, wherein the controller is configured to limit a change amount of the volume adjustment by the second adjuster within a predetermined value.

8. The sound processing apparatus as claimed in claim 1, wherein the first output destination is a main output channel, and the second output channel is a monitor output channel.

9. A method for setting volume of a sound signal by a processor, comprising:

a first adjustment step of adjusting volume of an input sound signal, the sound signal having the volume adjusted by the first adjustment step being sent to a first output destination;

a second adjustment step of adjusting the volume of the sound signal before being subjected to the volume adjustment by the first adjustment step or the sound signal after having been subjected to the volume adjustment by the first adjustment step, the sound signal having the volume adjusted by the second adjustment step being sent to a second output destination different from the first output destination;

a step of selecting one of the sound signal before being subjected to the volume adjustment by the first adjustment step and the sound signal after having been subjected to the volume adjustment by the first adjustment step, the sound signal selected by the step of selecting being input to the second adjustment step for volume adjustment; and a step of, in response to the selection by the step of selecting being changed, changing the volume adjustment by the second adjustment step based on a volume difference between the sound signal before the volume adjustment by the first adjustment step and the sound signal after the volume adjustment by the first adjustment step.

10. The method as claimed in claim 9, wherein the step of changing changes the volume adjustment by the second adjustment step, based on the volume difference between the sound signal before the volume adjustment by the first adjustment step and the sound signal after the volume adjustment by the first adjustment step, so as to suppress a volume change in output of the second adjustment step responsive to a volume change in the sound signal to be input to the second adjustment step that occurs in response to the change of the selection by the step of selecting.

11. The method as claimed in claim 10, wherein the step of changing changes the volume adjustment by the second adjustment step in accordance with a reciprocal number of the volume difference once the selection by the step of selecting is changed in such a manner that switching is effected from the sound signal before being subjected to the volume adjustment to the sound signal after having been subjected to the volume adjustment, and change the volume adjustment by the second adjustment step in accordance with the volume difference once the selection by the step of selecting is changed in such a manner that switching is effected from the sound signal after having been subjected to the volume adjustment to the sound signal before being subjected to the volume adjustment.

12. The method as claimed in claim 9, wherein the step of changing includes a step of acquiring information indicative of the volume difference based on a volume adjusting value set in the first adjustment step.

13. The method as claimed in claim 9, wherein the step of changing includes a step of acquiring information indicative of the volume difference based on a measured value of volume of the sound signal before being subjected to the volume adjustment and a measured value of volume of the sound signal after having been subjected to the volume adjustment.

14. The method as claimed in claim 13, wherein the step of changing includes a step of obtaining an average value for each of the measured values of volume and acquire the information indicative of the volume difference based on a difference between the obtained average values of the measured values of volume.

15. The method as claimed in claim 9, wherein the step of changing includes a step of limiting a change amount of the volume adjustment by the second adjuster within a predetermined value.

16. The method as claimed in claim 9, wherein the first output destination is a main output channel, and the second output channel is a monitor output channel.

17. A computer-readable, non-transitory storage medium storing a group of instructions executable by a processor for performing a method for adjusting volume in a sound processing apparatus, the sound processing apparatus comprising: a first adjuster that adjusts volume of an input sound signal, the sound signal having the volume adjusted by the first adjuster being sent to a first output destination; a second adjuster that adjusts the volume of the sound signal before being subjected to the volume adjustment by the first adjuster or the sound signal after having been subjected to the volume adjustment by the first adjuster, the sound signal having the volume adjusted by the second adjuster being sent to a second output destination different from the first output destination; and a selector that selects one of the sound signal before being subjected to the volume adjustment by the first adjuster and the sound signal after having been subjected to the volume adjustment by the first adjuster, the sound signal selected by the selector being input to the second adjuster for volume adjustment, the method comprising:

a step of, in response to the selection by the selector being changed, changing the volume adjustment by the second adjuster based on a volume difference between the sound signal before the volume adjustment by the first adjuster and the sound signal after the volume adjustment by the first adjuster.

* * * * *